United States Patent [19]

Bright et al.

[11] 4,453,792

[45] Jun. 12, 1984

[54] HIGH CURRENT DRAWER CONNECTOR

[75] Inventors: Edward J. Bright, Elizabethtown; William V. Pauza, Palmyra, both of Pa.

[73] Assignee: AMP Incorporated, Harrisburg, Pa.

[21] Appl. No.: 419,659

[22] Filed: Sep. 20, 1982

[51] Int. Cl.[3] ..... H01R 13/18

[52] U.S. Cl. ..... 339/64 R; 339/205; 339/255 R

[58] Field of Search ..... 339/64 R, 64 M, 204, 339/205, 248 R, 248 S, 255 R

[56] References Cited

U.S. PATENT DOCUMENTS

| | | | |
|---|---|---|---|
| 2,254,914 | 9/1941 | Rugg | 266/166 |
| 2,751,471 | 6/1967 | Wills | 200/166 |
| 2,872,659 | 2/1959 | Wills | 339/255 |
| 3,192,498 | 6/1965 | Ruehlemann | 339/258 R |
| 3,444,504 | 5/1969 | Lynch et al. | 339/64 |
| 4,087,668 | 5/1978 | Nakanishi et al. | 200/254 |
| 4,230,388 | 10/1980 | Thierry et al. | 339/205 |

FOREIGN PATENT DOCUMENTS

| | | | |
|---|---|---|---|
| 2005923 | 8/1971 | Fed. Rep. of Germany | 339/248 R |
| 1325047 | 3/1963 | France | 339/255 R |

*Primary Examiner*—John McQuade
*Assistant Examiner*—Gary F. Paumen
*Attorney, Agent, or Firm*—Allan B. Osborne

[57] ABSTRACT

The present invention relates to a connector for joining high current-carrying devices, such as bus bars, used in computers and the like. More particularly, the connector includes one or more contact units each consisting of two elongated contact blades held loosely together by spring members. Tab terminals are received into the units from either end. The contact blades are able to move, as a unit or separately, to accept misaligned tab terminals.

2 Claims, 6 Drawing Figures

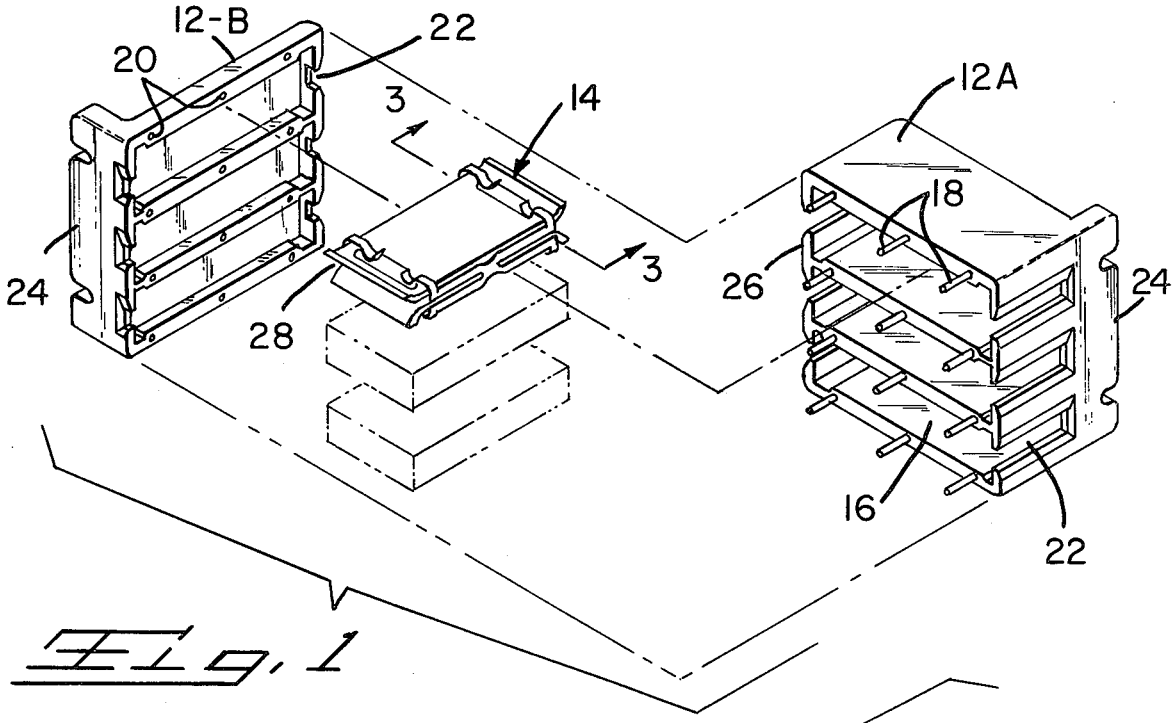
Fig. 1
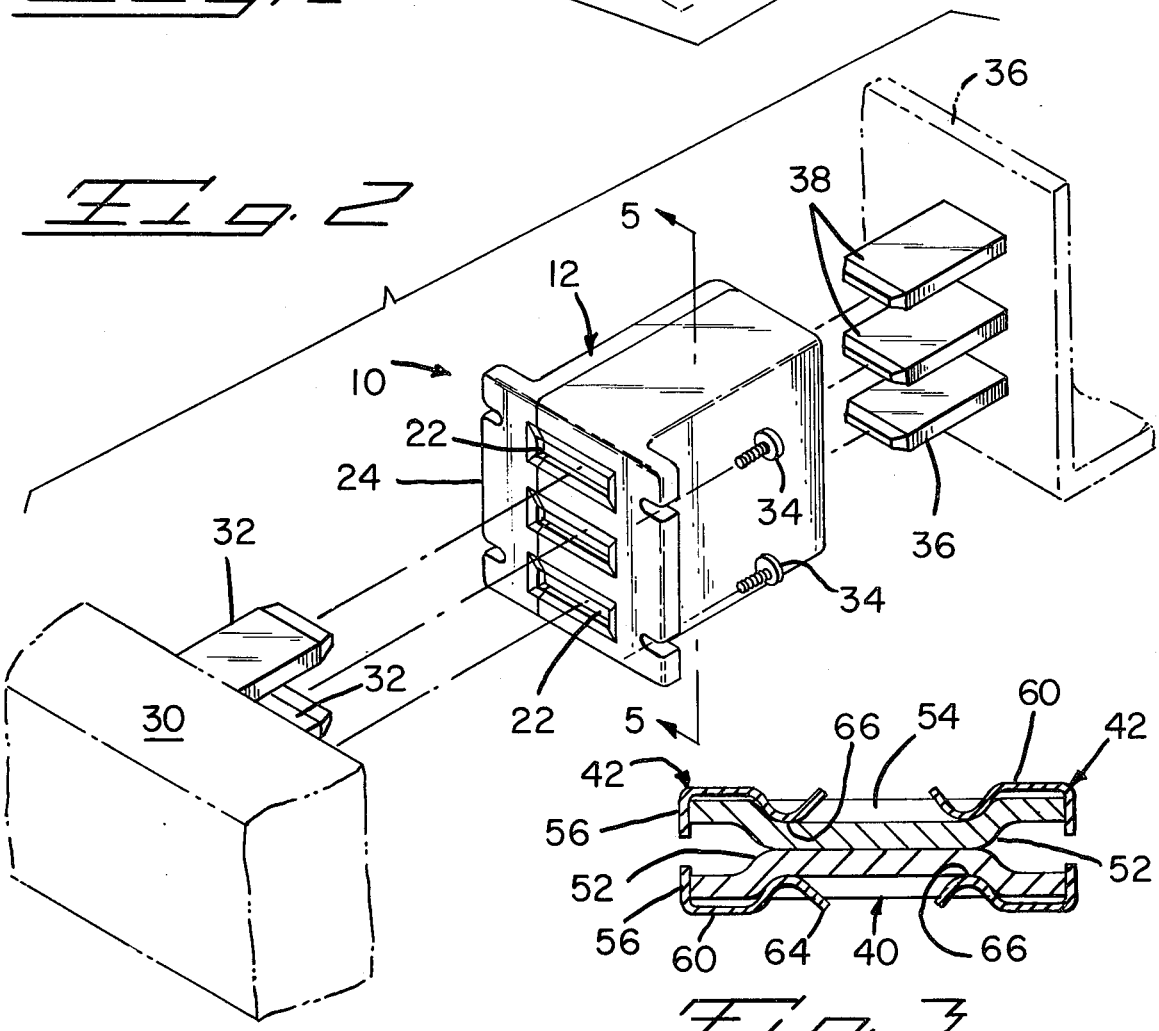
Fig. 2
Fig. 3

HIGH CURRENT DRAWER CONNECTOR

BACKGROUND OF THE INVENTION

1. The Field of the Invention

The invention disclosed herein relates to connectors having conductive contact units which are movably mounted such that they are permitted a certain degree of movement and are accordingly able to receive misaligned terminals.

2. The Prior Art

U.S. Pat. No. 3,444,504 discloses one form of an electrical connector wherein the contact section has limited movement independent of the housing in which it is positioned. The contact section is attached to a blade section having weak flexural strength which provides the contact section with a certain degree of movement so that it may effectively mate with a misaligned terminal.

SUMMARY OF THE INVENTION

The invention disclosed herein may be characterised as consisting of a contact unit positioned in an insulating housing having access slots to tab terminal receiving openings at either end of the unit. The unit itself consists of a pair of elongated, identical blades held together in parallel relation by spring members which permit limited blade separation in both the horizontal and vertical planes.

BRIEF DESCRIPTION OF THE DRAWINGS

FIG. 1 is an isometric view of the connector of the present view with the housing thereof separated;

FIG. 2 is an isometric view showing the connector of FIG. 1 in one contemplated manner of usage;

FIG. 3 is a cross-sectional view of one contact unit, the view being taken along line 3—3 in FIG. 1;

DESCRIPTION OF THE INVENTION

Figure 4:
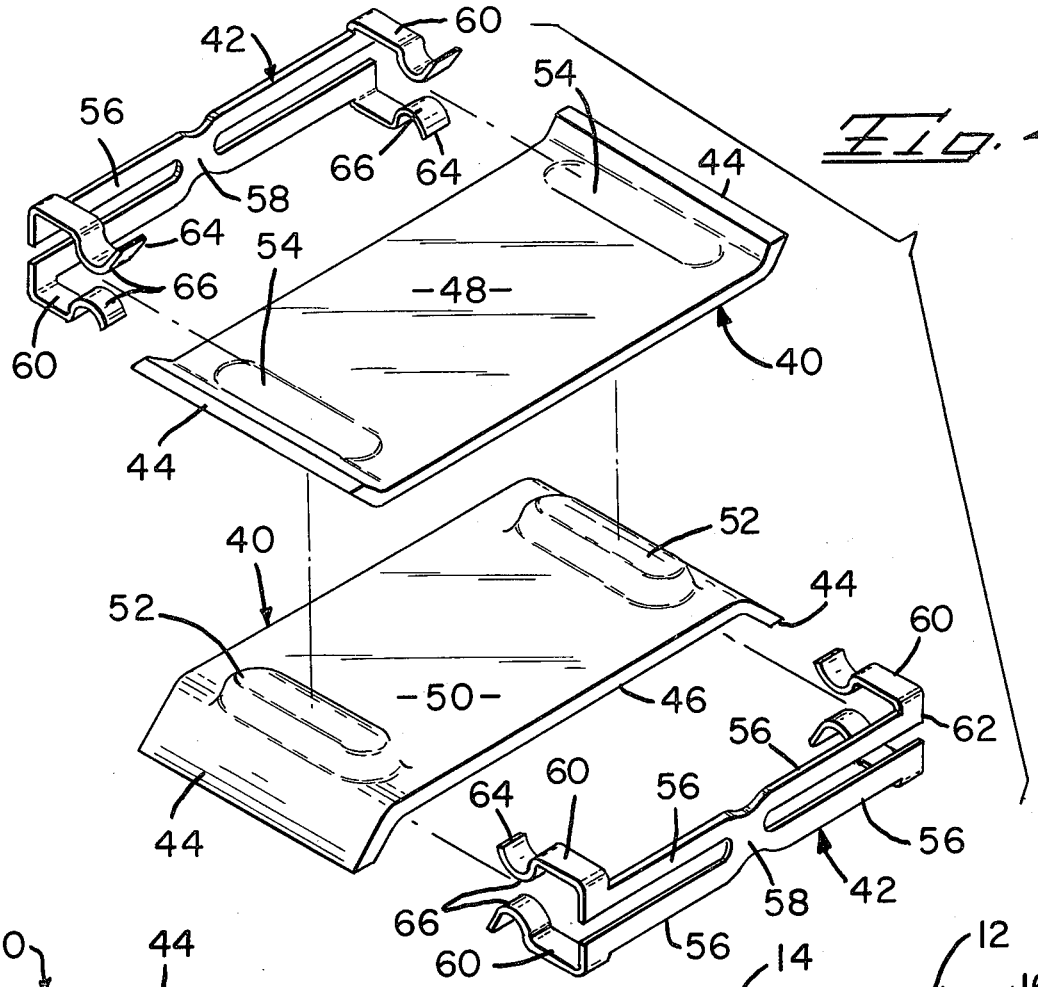
FIG. 4 is an isometric view of a contact unit shown in exploded fashion.

Connector 10 of FIG. 2 is shown in FIG. 1 with components housing 12 in two sections and contact units 14 (two being diagrammatically represented) between the two housing sections. The connector illustrated in the drawings show a housing adapted to contain three contact units. The connector can be made to contain any number of units, however, from one on up.

The disassembled housing 12 of FIG. 1 suggests one and the preferred way of molding it; i.e., molding a first section 12-A containing substantially the full width of compartments 16 and a second section 12-B comprising substantially a cover plate. Pins 18 on section 12-A are received in holes 20 in section 12-B and hold the two sections together.

Slots 22 provide access to the compartments and are located in both front face 24 and back end 26 of the housing. The slot walls are beveled to facilitate tab terminal entry.

Figure 5:
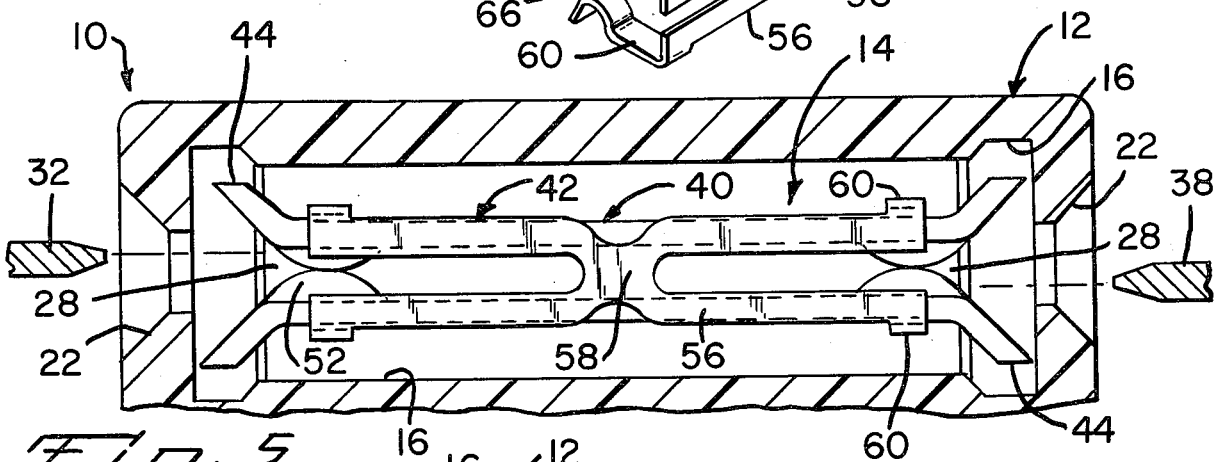
FIG. 5 is a view taken along line 5—5 of FIG. 2, partially in cross-section, showing a contact unit in the housing.
Figure 6:
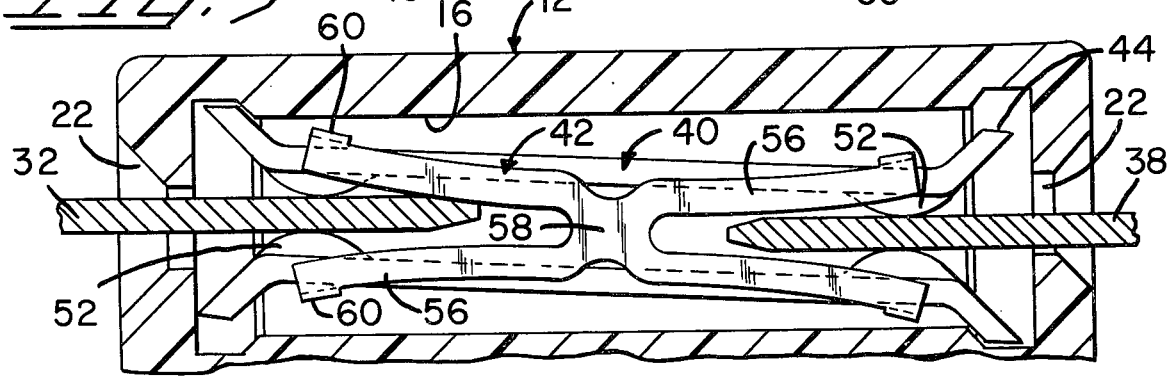
FIG. 6 is the view of FIG. 5 showing misaligned tab terminals received in the contact unit.

Contact units 14 are positioned loosely in the compartments with unit ends 28 facing slots 22 such as shown in FIGS. 5 and 6.

FIG. 2 shows a connector 10 in one type of usage. To the left of the connector is a high current-carrying bus bar 30 having three tab terminals 32 (only two are visible) extending laterally therefrom. This type bar may be found mounted in a computer cabinet or the like and connector 10 is secured to the bar by machine screws 34, with tab terminals 32 inserted into compartments 16 through slots 22 and into contact units 14 as shown in FIG. 6.

A drawer 36, shown to the right of the connector in FIG. 2 is the type in which several printed circuit boards (not shown) are mounted for use in a computer. Each board is connected to one of the tab terminals 38 shown extending rearwardly from the drawer. Drawer 36 is movable towards and away from connector 10 mounted on bus bar 30. The boards in the drawer are energized by sliding the drawer rearwardly so that tab terminals 38 thereon enter connector 10 and more particularly, contact units 14 therein. FIG. 6 shows connector 10 providing the electrical connection between bus bar 30 (only tab terminals 32 shown) and drawer 36 (only tab terminals 38 shown). Alternatively, connector 10 can be secured to the back of drawer 36 for movement onto the tab terminals on bus bar 30.

As is well known, manufacturing tolerances on main frames and drawers 36 used thereon are not close. Accordingly, the insertion match between contact units 14 in connector 10 and tab terminals 38 on the drawer may be and often is less than perfect. It becomes necessary then that some forgiveness is available somewhere between the drawer and bus bar; i.e., connector 10 and more particularly, contact units 14 therein.

FIGS. 3 and 4 will now be referred to in describing the novel features of contact units 14 which permit the aforementioned misalignment while at the same time providing an extremely good electrical connection required for high currents.

A contact unit 14 is shown in FIG. 4 in an exploded manner. Each unit includes a pair of identical blades 40 and a pair of identical spring members 42.

Ends 44 on blades 40 are turned or bent obliquely out of the plane of the blade with the degree of bending, relative to intermediate section 46; i.e., the portion of the blade between ends 44, being about forty-five degrees. The side towards which the ends are bent is hereinafter referred to as the outer side 48 of each blade. The opposite side then is referred to as the inner side 50.

With respect to the intermediate section 46 of the blade, a pair of raised contact surfaces 52 are provided on inner side 50 with one contact surface adjacent each end 44. The raised contact surfaces preferrably extend across most of the width of the blade.

The raised contact surfaces are stamped so that corresponding depressions 54 are in outer side 48.

Blades 40 are preferrably made from half-hard copper and plated with silver.

Spring members 42 may be characterised as being elongated and narrow with a set of two parallel arms 56 extending from each side of center section 58. Fingers 60 extend down from the side of the free end 62 of each arm. The free ends 64 of each finger is a concavo-convex shape with the convex surface 66 facing in towards the convex surface on the adjacent finger.

The edges of center section 58 curve in to reduce the size of the section so that it functions more easily as a pivot point for arms 56. Spring members 42 are preferrably made from stainless steel.

Contact unit 14 is assembled by holding the two blades 40 together, inner sides 50 facing each other, and clipping spring members 42 over the edges of the blades. The convex surfaces 66 on fingers 60 are received in depressions 54 in the outer sides 48 of the blades. FIG. 3 shows this.

As assembled, the raised contact surfaces 52 on one blade abutt surfaces 52 on the parallel blade. Further, the turned out ends 44 provide a beveled entrance to guide tab terminals in between the blades and particularly between the raised contact surfaces.

FIG. 5 shows a contact unit 14 positioned in compartment 16 in housing 12. Further, connector 10 which the aforementioned components form, is between tab terminals 32 of bar 30 and tab terminals 38 of drawer 36. As illustrated in the drawing of that figure, the tab terminals are offset relative to each other, with connector 10 and with contact unit ends 28. Normally the connector would be in alignment with bus bar 30 to which it is mounted. For purposes of illustration, however, it is assumed that the holes in bus bar 30 receiving machine screws 34 on connector 10 are out of alignment with tab terminals 32. Accordingly, as shown in FIG. 6, tab terminals 32 has been inserted into unit end 28 off-center in a direction towards the top of the drawing sheet. Similarly, tab terminal 38 enters the opposite unit end off-center towards the bottom of the drawing sheet. Contact unit 14 absorbs this misalignment in two ways. First, it has room within compartment 16 to move. Thus, the left end moves up and of course, the right end must move down. Secondly, the blades move apart differentially; i.e., the blade ends spread apart non-symmetrically relative to the center line (not shown) of the particular compartment.

As the tab terminals enter in between contact surfaces 52 the blades are able to spread apart by arms 56 pivoting outwardly about center section 58 such as shown in an exaggerated scale in FIG. 6. The result of the arms pivoting about is that a significant force is continuously pressed against the tab terminals so that the contact surfaces transfer high current between the tab terminals and blades very effectively without significant heat rise. Further, the raised contact surfaces 52 serve to concentrate the force to enhance even more the current transfer.

The foregoing detailed description has been given for clearness of understanding only, and no unnecessary limitations should be understood therefrom, as some modifications will be obvious to those skilled in the art.

I claim:

1. A high current drawer connector, comprising:

a. a housing having a compartment with slots through each endwall providing access thereinto; and b. a contact unit positioned in the compartment and adapted to receive tab terminals through the slots for electrical connection therewith, said unit comprising:

i. a pair of identical blades, each having an intermediate section with a raised contact surface on an inner side and with the ends of the blades being bent obliquely outwardly from the plane of the intermediate section, the two blades being placed together with the inner sides facing each other and the raised contact surfaces in abutting relation, and the bent-out ends cooperating to form a beveled entrance into the facing inner sides; and ii. a pair of resilient, elongated spring members, each spring member having a set of parallel, spaced-apart arms attached to and extending from opposite sides of a center section, and with a finger extending from the side of each arm adjacent the free end thereof so that the fingers on each set of parallel arms define a U-shape clip, said spring members being positioned along the opposing edges of the two blades with the fingers extending down the outer sides to hold the blades resiliently together so that upon a tab terminal entering the compartment through one of the slots, the tab terminal can be inserted in between the raised contact surfaces, the blades can spread apart by the arms pivoting about the attachment with the center section.

2. The connector of claim 1 further including depressions on the outer side of the blades corresponding to the raised contact surfaces on the inner side and a concavo-convex shape on the free ends of the fingers with the convex surfaces being received in the depressions.

* * * * *